US006342181B1

(12) United States Patent
Newkirk et al.

(10) Patent No.: US 6,342,181 B1
(45) Date of Patent: Jan. 29, 2002

(54) CORROSION RESISTANT NICKEL-BASED ALLOY

(75) Inventors: Joseph W. Newkirk, Rolla; Sanhong Zhang, Manchester, both of MO (US)

(73) Assignee: The Curators of the University of Missouri, Columbia, MO (US)

( * ) Notice: Subject to any disclaimer, the term of this patent is extended or adjusted under 35 U.S.C. 154(b) by 0 days.

(21) Appl. No.: 09/528,080

(22) Filed: Mar. 17, 2000

(51) Int. Cl.[7] ..... C22C 19/03
(52) U.S. Cl. ..... 420/455; 420/441; 148/426
(58) Field of Search ..... 420/441, 455; 148/426

(56) References Cited

U.S. PATENT DOCUMENTS

| | | | | |
|---|---|---|---|---|
| 1,514,064 A | * | 11/1924 | Mandell | 420/451 |
| 1,984,474 A | | 12/1934 | Good | 148/21.8 |
| 2,159,810 A | * | 5/1939 | Lenz et al. | 250/27.5 |
| 2,184,926 A | | 12/1939 | Kann | 51/280 |
| 2,220,792 A | | 11/1940 | Moore | 148/21.8 |
| 2,222,474 A | * | 11/1940 | Bishop | 75/170 |
| 2,472,027 A | | 5/1949 | Evans et al. | 148/21.8 |
| 3,000,770 A | | 9/1961 | Wittmoser | 148/35 |
| 3,559,775 A | | 2/1971 | Miller | 188/251 |
| 3,565,698 A | | 2/1971 | de Beaulieu | 148/3 |
| 3,600,159 A | | 8/1971 | Moore et al. | 75/123 |
| 4,561,892 A | * | 12/1985 | Kumar et al. | 75/251 |
| 4,767,278 A | | 8/1988 | Enderlein, Jr. | 416/241 B |
| 4,853,183 A | | 8/1989 | Johnson et al. | 420/454 |
| 4,891,183 A | * | 1/1990 | Corwin | 420/435 |
| 4,900,638 A | * | 2/1990 | Emmerich | 428/606 |
| 4,929,288 A | | 5/1990 | Borges | 148/326 |
| 5,201,965 A | | 4/1993 | Ohtsuka et al. | 148/333 |
| 5,588,982 A | | 12/1996 | Hendrix | 75/10.5 |

FOREIGN PATENT DOCUMENTS

| | | | |
|---|---|---|---|
| JP | 52-110218 A | * | 9/1977 |
| JP | 3-274242 A | * | 12/1991 |

OTHER PUBLICATIONS

Woldman, Norman E., Ph.D., Engineering Alloys, p. 20, Hastelloy D. No Publication Data are Available!.
Resistance of Nickel and High Nickel Alloys to Corrosion by Hydrocloric Acid, Hydrogen Chloride and Chlorine, p. 3, Hastelloy alloy D. No Publication Data are Available!.
ASTM Deisgnation: A 518–92, Standard Specification for Corrosion–Resistant High–Silicon Iron Castings No Year Data!.

* cited by examiner

*Primary Examiner*—Roy King
*Assistant Examiner*—Harry D Wilkins, III
(74) *Attorney, Agent, or Firm*—Edward H. Renner; Grace J. Fishel

(57) ABSTRACT

A nickel based, high silicon alloy exhibits very high corrosion resistance in high temperature sulfuric acid environments. The alloy may be cast and is sufficiently ductile to be fabricated and machined. The alloy is ductile and has sufficient resistance to mechanical and thermal shock to be reliable in service when used as rotating parts. The alloy may have the following composition, in percent by weight:

| | |
|---|---|
| Nickel | about 82–86% |
| Silicon | about 9–11% |
| Niobium | about 3–6% |
| Cerium | about 0–0.1% |
| Boron | about 0.–0.11% |
| Cesium | about 0.1–0.7% |
| Lanthanum | about 0.04–0.3% |
| Neodymium | about 0.04–0.3% |
| Iron | about 0–0.65% |
| Carbon | about 0–0.08%. |

20 Claims, No Drawings

CORROSION RESISTANT NICKEL-BASED ALLOY

TECHNICAL FIELD

The present invention relates generally to high silicon corrosion resistant alloys and, more particularly, to nickel-based alloys which are used in corrosive environments, for example, environments containing hot mineral acids.

BACKGROUND OF THE INVENTION

Applicant is aware of the following U.S. patents, the disclosures of which are incorporated by reference herein:

| | | |
|---|---|---|
| 1,984,474 | 2,184,926 | 2,220,792 |
| 2,472,027 | 3,000,770 | 3,559,775 |
| 3,565,698 | 3,600,159 | 4,767,278 |
| 5,201,965 | 5,588,982 | |

Equipment used in highly corrosive environments typically is constructed of metal alloys designed to offer greater corrosion resistance, such as stainless steel or other high alloys. These alloys are necessary to withstand the extremely corrosive effects of chemicals such as hot concentrated sulfuric acid and the like. High silicon alloys such as Hastelloy-D™ (Ni-10Si-3Cu) and Duriron™ (Fe-15Si-3.5Mo) are commonly used in the chemical processing industry for these environments. These alloys provide good high temperature corrosion resistance in these environments within limitations. However, both alloys are susceptible to brittle failure due to poor ductility, for example, less than 1% elongation on a tensile test. Equipment manufactured from these alloys is susceptible to failure when subjected to either mechanical or thermal shock loads and the very low ductility limits the use of these alloys in fabrication of some parts.

A typical application requiring use of high alloy material is the recovery of spent sulfuric acid. The production of titanium dioxide via the sulfate process results in a waste stream of 20% sulfuric acid. Historically, this waste stream was disposed of by a variety of methods, such as, deep well injection or neutralization followed by landfill. Environmental concerns have eliminated these disposal methods. A common method of recovering this waste stream is to increase the acid concentration to 93%, for example, using a forced circulation evaporator. The concentrated acid may then be reused in the production of titanium dioxide. The acid concentration is normally carried out in multiple stages and the acid temperature is kept as high as possible to minimize vacuum requirements. Stainless steel or other high alloy materials offer acceptable corrosion resistance in the 20 to 60% and 80 to 93% concentration range at temperatures approaching the boiling point. However, metallic components handling acid in the 60 to 80% concentration range at high temperature must be handled with Ni-9Si-3Cu (Hastelloy D™) alloy or Fe-15.5Si-3.5Mo alloy (Duriron™), based on acceptable corrosion resistance.

The alloy of this invention offers significantly improved life for fluid handling equipment in this environment and in similar corrosive environments. In particular, the greatly improved ductility increases the durability of parts formed from the instant alloy.

SUMMARY OF THE INVENTION

Nickel and iron based alloys have long been known to be highly resistant to sulfuric acid. Alloys with as much as 14.5% Si have been used for a broad range of concentrations and up to the boiling point of sulfuric acid. This high resistance comes at the cost of low tensile strengths and extreme brittleness. A conventional alloy used in concentrated sulfuric acid is Hastelloy D™, which is a nickel based alloy containing silicon and copper. Although Hastelloy D™ shows excellent corrosion resistance in concentrated sulfuric acid, this alloy is hard and brittle.

The instant invention overcomes this brittleness in conventional nickel-based high silicon alloys and yet retains, and may improve, the corrosion resistance.

In accordance with the present invention, there is provided a nickel-based alloy having high corrosion resistance to severe sulfuric acid environments. The alloy may have a nickel content of between about 82 to 86%, a silicon content of between about 9 to 11% by weight, preferably between about 9.8 to 10.6%, a niobium content of between about 3 to 6% by weight, preferably between about 3.3 to 5.5% and more preferably about 3.3 to 4.4%, a boron content of between about 0–0.11%, a cerium content of between about 0% to 0.10%, and the balance comprising misch-metal (50% cesium, 20% lanthanum; 20% neodymium). These percentages are by weight. The alloy of the present invention has a high resistance to corrosion while maintaining sufficient ductility for machining. A ductility of greater than 1% elongation to fracture can be achieved. This ductility is effective to be cast and machined. The alloy is resistant to mechanical and thermal shock. The alloy can be used in rotating machinery, such as pump parts, which require mechanical strength.

It is an object of the present invention to provide an alloy for use in highly corrosive environments.

It is an object of the present invention to provide an alloy which is resistant to corrosion in a concentrated sulfuric acid environment.

It is an object of the present invention to provide an alloy which is resistant to corrosion and has sufficient ductility to be fabricated and survive in service.

It is an object of this invention to provide a high silicon nickel based alloy having high corrosion resistance in concentrated sulfuric acid environments.

It is an object of this invention to provide a high silicon nickel based alloy having improved ductility.

It is a further object of this invention to provide a high silicon nickel based alloy which is substantially free of elements which reduce alloy ductility, while providing an alloy having high corrosion resistance in hot mineral acids, such as hot concentrated sulfuric acid.

It is a further object of this invention to provide a high silicon nickel based alloy which is castable, machinable and weldable.

These and other objects of the invention will be apparent from the following Description of the Preferred Embodiments.

DESCRIPTION OF THE PREFERRED EMBODIMENTS

The alloy of the invention is a corrosion-resistant nickel-silicon intermetallic alloy. The alloy contains from between about 9.9% to 11% silicon, preferably between about 9.8 to 10.6%, between about 3 to 6% niobium, preferably 3.3 to 5.5% and most preferably between about 3.3 to 4.4%, between about 0% to 0.11% boron, between about 0.2% to 1.3% misch-metal (approximately 50% cesium, 20% lanthanum, and 20% neodymium). The balance of the alloy is nickel, with normal residual elements. The amount of residues, such as sulfur, phosphorous and like materials, is kept below the level at which they would have a deleterious effect on the properties of the alloy. Preferably the aggregate of all such trace materials is below about 0.2% by weight. Further, the carbon content is between about 0 to 0.8% and the iron content is between about 0 to 0.65%.

The principal alloying element of the intermetallic alloy, after nickel, is silicon. The high silicon content provides corrosion resistance in both oxidizing and reducing environments. The niobium content provides ductility to the alloy. The substitution of a portion of the niobium with titanium does not detract from the ductility of the alloy. Titanium and combined titanium-niobium addition s enhance ductility, however, corrosion resistance in 60% to 80% sulfuric acid is not as high as alloys containing niobium and no titanium. However, the presence of niobium especially enhances the ductility of the alloy and the resulting alloy has high corrosion resistance throughout a broad temperature range of 20 to 93% sulfuric acid. Consequently, the niobium modified alloy is preferred for broad range service.

The boron content is preferably between about 0% to 0.11%, based on the total weight of the alloy. The presence of boron additionally enhances ductility in the high silicon alloy of the invention. A further modifier is cerium, preferably added at between about 0 to 0.1%. The amount of these modifiers is not critical, but they should not be added in excessive amounts and generally at less than about 0. 15% by weight.

Mischmetal (approximately 50% cesium, 20% lanthanum, and 20% neodmium) addition of between about 0.2% to 1.3% by weight promotes grain refinement in the ascast condition and improves ductility in the as-cast condition. That is, cesium may be present at between bout 0.1 to 0.7%; lanthanum between about 0.04 to 0.3% and neodymum between about 0.04 to 0.3%.

The remainder of the alloy consists of nickel and residual elements and impurities, such as carbon, phosphorus, sulfur, carbon and iron.

Chromium, molybdenum, and copper additions are conventionally used to enhance corrosion resistance in sulfuric acid environments. However, the addition of these elements can drastically reduce ductility of the instant alloy in both the as-cast and solution annealed conditions. It is a feature of this invention that the presence of these elements in the alloy is kept to a minimum that does not interfere with the ductility of the resultant alloy.

The alloy of the instant invention may be produced by conventional modern foundry practice suitable for high alloys, such as in an induction furnace. Laboratory heats were produced in an induction furnace under an argon atmosphere and the test samples were cast in graphite molds.

The alloy of the instant invention is suitable for producing cast parts and may be used in the as-cast condition. Further conventional treatment can enhance the properties of the alloy, for example, heat treatment can improve the homogeneity of the alloy, and dissolve detrimental gamma phase needles and alpha phase dendrites.

The preferred alloy is primarily beta phase; it exhibits a transgranular fracture and is readily weldable. Conventional machining techniques, such as milling and grinding, may be used to shape cast parts. The produced parts are durable and have the strength and shock resistance necessary for rotating machinery, such as pump impellers used in handling hot concentrated sulfuric acid.

The following tables summarize data from representative heats.

TABLE I

| | Composition Weight Percent | | | | |
|---|---|---|---|---|---|
| | By Analysis | | | | |
| SAMPLE | Si | Nb | B | Ce | Ni |
| 1 (616B) | 10.4 | 3.25 | 0.10 | 0.08 | Balance |
| 2 (617B) | 10.0 | 4.20 | 0.10 | 0.08 | Balance |
| 3 (A679) | 10.2 | 4.6 | 0.10 | — | Balance |
| 4 (A681) | 10.2 | 4.65 | 0.12 | 0.06 | Balance |

The materials were tested for corrosion resistance in sulfuric acid over the course of six days. Table II shows the corrosion rates for the materials after 3 days and Table III shows the corrosion rates of the materials after an additional 3 days. The tested samples were solution heat treated at 950° C. for 24 Hours.

TABLE II

| Static Corrosion Laboratory Tests in Sulfuric Acid Rates - mils per year (0.001 inch per year) First Three Days | | | |
|---|---|---|---|
| | Sulfuric Acid Concentration | | |
| Sample | 60% | 70% | 80% |
| 1 (616B) | 805 | 89 | — |
| 2 (617B) | 685 | — | 26.5 +/− 0.7 |
| 3 (A679) | 60 | 110 | — |
| 4 (A681) | — | 4 | — |

TABLE III

| Rates - mils per year (0.001 inch per year) Second Three Days | | | |
|---|---|---|---|
| | Sulfuric Acid Concentration | | |
| Sample | 60% | 70% | 80% |
| 1 (616B) | 460 | 25 +/− 0.7 | — |
| 2 (617B) | 563 | — | 6.5 +/− 0.7 |
| 3 (A679) | 480 | 18 | — |
| 4 (A681) | — | 0.3 | — |

TABLE IV

| Mechanical Test Data | | | |
|---|---|---|---|
| Sample | Yield Strength (ksi) | Tensile Strength (ksi) | % Elong.- 2 inch gage length |
| 1 (616B) | 92 +/− 5.7 | 114.2 +/− 2.5 | 2.2 +/− 0.4 |
| 2 (617B) | 85.5 +/− 3.5 | 114.2 +/− 0.7 | 2.5 |
| 3 (A679) | — | 110 | 3.0 |
| 4 (A681) | — | 95 | 1.8 |

Various changes and modifications may within the purview of this invention, as will be readily apparent to those skilled in the art. Such changes and modifications are within the scope and teachings of this invention as defined by the claims appended hereto. The invention is not be limited by the examples given herein for purposes of illustration, but only by the scope of the appended claims and their equivalents.

We claim:

1. A low copper, high silicon, nickel-based alloy, said alloy having a nickel content of between about 82 to 86%, a silicon content of between about 9% to 11%, a niobium content of between about 3.3% to 5.5%, a boron content of between about 0–0.11% and cerium being present in the alloy at less than about 0.15%, wherein all percents are by weight, whereby said alloy has sufficient ductility, in the as cast condition as well as when heat treated, to produce machine parts having sufficient mechanical strength for rotating machinery and being resistant to fracture from thermal and mechanical shock.

2. The alloy of claim 1, wherein said alloy has a transgranular fracture mode.

3. The alloy of claim 1, wherein said alloy has a high corrosion resistance to severe mineral acid environments.

4. The alloy of claim 3, wherein said alloy is highly corrosion resistant in hot sulfuric acid environments.

5. The alloy of claim 4, wherein said alloy is highly corrosion resistant in hot sulfuric acid concentrations of between about 60% to 80% by weight.

6. The alloy of claim 1, wherein said alloy is castable.

7. The alloy of claim 1, wherein said alloy is weldable.

8. The alloy of claim 1, wherein said alloy is machinable.

9. The alloy of claim 1, wherein part of the niobium is replaced by titanium.

10. The alloy of claim 1 wherein the alloy has a ductility of at least 1% elongation to fracture.

11. A high silicon nickel-based alloy having high corrosion resistance to severe sulfuric acid environments, said alloy having a nickel content of between about 82% to 86%, a silicon content of about 10.6%, a niobium content of about 3.3%, a boron content of about 0.10% and a cerium content of about 0.08%, wherein all percents are by weight, said alloy having a high resistance to corrosion while maintaining sufficient ductility for machining and having sufficient resistance to mechanical and thermal shock to be durable in service.

12. A nickel-based high silicon alloy having high corrosion resistance to severe sulfuric acid environments, said alloy having a nickel content of between about 82% to 86%, a silicon content of about 9.8%, a niobium content of about 4.4%, a boron content of about 0.10% and a cerium content of about 0.08%, wherein all percents are by weight, said alloy having a high resistance to corrosion while maintaining sufficient ductility for machining and having sufficient resistance to mechanical and thermal shock to be durable in service.

13. A nickel based high silicon alloy having very high corrosion resistance, the alloy consisting essentially of between about 9 to 11% by weight silicon, between about 3.0 to 6% by weight niobium, up to about 0.11% by weight boron, cerium being present in the alloy at up to about 0.1% by weight, up to about 0.7% by weight cesium, up to about 0.3% by weight lanthanum, up to about 0.3% by weight neodymium, the balance, being nickel and trace elements, the alloy having very high corrosion resistance to hot sulfuric acid solutions in a broad range of acid concentrations, the alloy further having substantial ductility said ductility being sufficient to produce cast and machined parts having sufficient mechanical strength for rotating machinery and resistant to fracture from thermal and mechanical shock.

14. A high silicon, nickel-based alloy, the alloy having a silicon content above about 9% by weight a niobium content of between about 3 to 6% by weight, and cerium being present in the alloy at up to about 0.1% by weight, the silicon and nickel content being effective in combination to provide high corrosion resistance to the alloy and the niobium and cerium content in combination being effective in the alloy to provide sufficient as cast ductility to produce machine parts having sufficient mechanical strength for rotating machinery and being resistant to fracture from thermal and mechanical shock.

15. The alloy of claim 14, wherein part of the niobium is replaced by titanium.

16. The alloy of claim 14, wherein the alloy is highly corrosion resistant in hot sulfuric acid of concentrations of between about 60 to 80% by weight.

17. The alloy of claim 14, wherein the alloy is castable.

18. The alloy of claim 14, wherein the alloy is weldable.

19. The alloy of claim 14, wherein the alloy is machinable.

20. The alloy of claim 14, wherein the alloy has a very high corrosion resistance in mineral acid environments, including hot sulfuric acid concentrations of between about 60 to 80% by weight, the alloy consisting essentially of between about 9.8 to 10.6% by weight silicon, between about 3.3 to 4.4% by weight niobium, up to about 0.11% by weight boron, cerium being present the alloy at up to about 0.1% by weight, up to about 0.7% by weight cesium, up to about 0.3% by weight lanthanum, up to about 0.3% by weight neodymium, the balance, being nickel and trace elements, the alloy having very high corrosion resistance to hot sulfuric acid solutions in a broad range of acid concentrations, the alloy being weldable and the alloy further having substantial ductility of above at least 1% elongation to fracture, said ductility being effective to produce cast and machined parts having sufficient mechanical strength for rotating machinery and resistant to fracture from thermal and mechanical shock.

* * * * *